United States Patent [19]

Faulstich

[11] 3,974,932

[45] Aug. 17, 1976

[54] CAP WITH TEAR STRIP FOR CONTAINER NECKS

[75] Inventor: George W. Faulstich, San Carlos, Calif.

[73] Assignee: Three Sisters Ranch Enterprise, San Carlos, Calif.

[22] Filed: May 27, 1975

[21] Appl. No.: 580,556

[52] U.S. Cl. ..... 215/256

[51] Int. Cl.[2] ..... B65D 41/46

[58] Field of Search ..... 215/254, 256, 253; 220/270

[56] References Cited

UNITED STATES PATENTS

| | | | |
|---|---|---|---|
| 2,772,802 | 12/1956 | Woydatt | 215/256 |
| 3,120,900 | 2/1964 | Faulstich | 215/256 |
| 3,142,403 | 7/1964 | Fox | 215/256 |
| 3,608,765 | 9/1971 | Faulstich | 215/256 |

*Primary Examiner*—Donald F. Norton
*Attorney, Agent, or Firm*—Julian Caplan

[57] ABSTRACT

The neck of a plastic container of the type originally intended for use with a foil type closure is formed with a top bead, a first reduced-diameter step and a second reduced-diameter portion and then a downward-outward widening breast. The cap has a top disk which seats on the neck and has an outer skirt having an internal upper bead engaging under the top bead and a second internal bead fitting deeply into the second reduced-diameter portion. An inner skirt depends from the disk and fits inside the neck. Thus the cap seats tightly on the container neck. To remove the cap, a circumferential internal weakened portion is formed in the outer skirt. A curved weakened portion extends up from the bottom edge of the outer skirt and merges with the circumferential weakened portion. A pull tab depends from the bottom edge of the skirt. By pulling upward on the tab, the portion of the outer skirt below the first reduced-diameter portion of the neck is torn away. The remainder of the cap may be snapped off and later replaced for reclosure.

4 Claims, 4 Drawing Figures

CAP WITH TEAR STRIP FOR CONTAINER NECKS

This invention relates to a new and improved plastic cap having a tear strip formed therein which fits over the neck of a container such as a plastic milk container.

One of the features of the invention is the fact that a secure cap is provided for use with an inexpensive type of disposable plastic container which heretofore has been closed by a foil cap in an ineffective manner. The plastic cap provides an air-tight and liquid-tight seal which is superior to the seals previously provided for containers of this design.

One of the further features of the invention is the fact that the cap cannot be removed without tearing the skirt along lines purposely formed therein. The fact that the skirt must be torn in order to open the cap makes tampering with the contents of the container detectable.

Another feature of the invention is the fact that after the skirt has been torn, permitting ready access to the interior of the container, a reclosure cap is provided which is relatively air and liquid-tight yet can be readily removed and replaced each time a portion of the contents of the container is dispensed.

Another feature of the invention is the fact that the cap may be installed by automatic capping machinery.

Other objects of the present invention will become apparent upon reading the following specification and referring to the accompanying drawings in which similar characters of reference represent corresponding parts in each of the several views.

Figure 1:
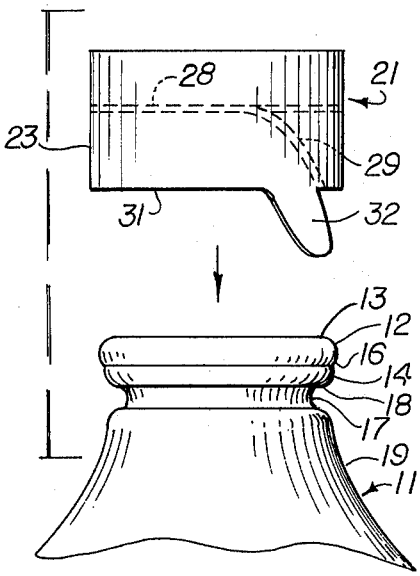
FIG. 1 is an exploded side elevation view of the container and cap prior to installation.

The container neck 11 illustrated herein is of a type which is commonly used on inexpensive plastic disposable milk containers. The top edge 13 of the cap is provided with a bead 12 which curves downwardly outwardly. Below the top bead 12 is a first reduced diameter portion 14 with a relatively abrupt top shoulder 16 between the reduced diameter portion 14 and bead 12. Reduced diameter portion 14 is approximately vertical. A second reduced diameter portion 17 of lesser outside diameter than the portion 14 is immediately below the latter with a relatively abrupt lower shoulder 18 between the two. Below the second reduced diameter portion 17 is a downwardly outwardly curving breast 19 which merges into the cylindrical portion of the bottle (not shown).

Figure 3:
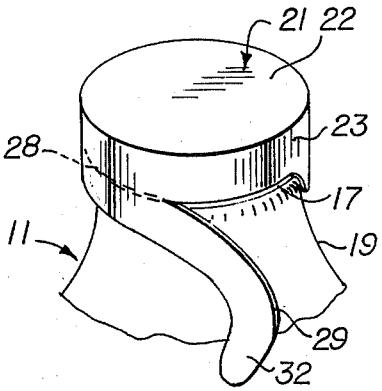
FIG. 3 is a perspective view showing the tear strip partially torn away.

Cap 21 is formed with a top disk 22 which seats on the top edge 13 of neck 11. A peripheral outer skirt 23 depends from disk 22, the skirt 23 having a relatively smooth cylindrical outside surface. The inside surface of skirt 23 is irregular. Thus an upper internal bead 24 in the assembled condition of the cap and neck fits securely under the bead 12 and engages under the shoulder 16. On the inside of the skirt 23, below bead 24 is a weakened portion 26 which is designated as a tear strip. Below weakened portion 26 is a lower bead 27 which fits deeply into the second reduced diameter portion 17 and engages under the shoulder 18. A curved weakened portion 29 extends up from the lower edge 31 of skirt 23 and merges with the circumferential weakened portion 28. To one side of weakened portion 29 is a pull tab 32 which depends from lower edge 31. By pulling tab 32 upwardly and thence clockwise around the cap 21 as viewed from the top of FIG. 3 the portion of the skirt 23 below line 28 is pulled away so that the cap and neck have the appearance shown in FIG. 4. When it is necessary to open the container, the reclosure cap 36 which remains after the lower portion of the skirt has been torn away can easily be pried off the bead 12 by reason of the fact that the edge 34 thereof is readily accessible. The reclosure cap 36 may be reinstalled each time a portion of the contents of the container has been dispensed.

Figure 2:
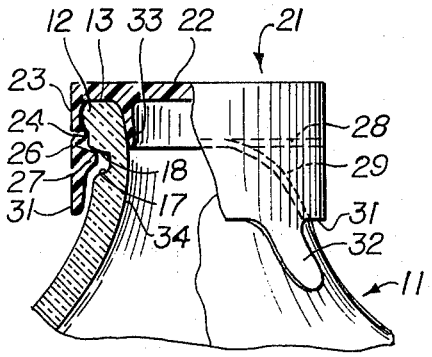
FIG. 2 is a side elevational view partly broken away in section showing the cap seated on the container neck.
Figure 4:
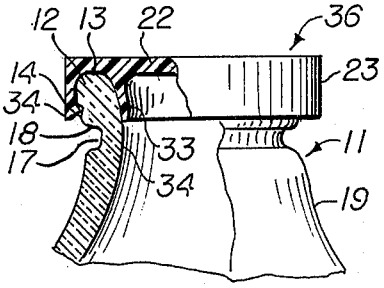
FIG. 4 is a view similar to FIG. 2 showing the portion of the cap above the tear strip used as a reclosure cap.

An inner skirt 33 fits along the inside 34 of the neck 11 and forms an inner seal both in the initial installation as shown in FIG. 2 and in the reclosure installation as shown in FIG. 4.

The cap is readily installed by conventional capping machinery. It will be seen particularly with reference to FIG. 2 that the various edges of the cap 21 slant inwardly upward and that the bead 12 is the large diameter portion of the upper end of the neck 11. Hence by pushing downward on cap 21 it snaps over the bead 12 and the internal bead 27 fits tightly under the shoulder 18 above the second reduced diameter portion 17.

What is claimed is:

1. In combination, a plastic, thin-walled container having a neck with a smooth inside diameter, an even top edge, and on the exterior of said neck a top bead, a first reduced diameter portion below said top bead with a substantially horizontal first shoulder above said first reduced diameter portion, a second reduced diameter portion below said first reduced diameter portion with a substantially horizontal second shoulder above said second reduced diameter portion, the external diameter of said neck between said first and second reduced diameter portions being substantially less than the external diameter of said neck above said first reduced diameter portion, said neck widening downwardly-outwardly below said second reduced diameter portion; and a cap of resilient, tearable plastic material formed with a flat top disk fitting on top of said top edge and a peripheral outer skirt depending from said disk and fitting over the outside of said neck, the exterior of said outer skirt comprising a substantially smooth cylinder, the inside of said outer skirt having an upper portion fitting outside said top bead, an upper internal bead fitting under said first shoulder, a lower internal bead fitting under said second shoulder and into said second reduced diameter portion, the inside diameter of said outer skirt being greater above said top bead than at said top bead and greater at said top bead than at said lower bead and about the same below said lower bead as above said top bead, said outer skirt formed with a circumferential reduced thickness portion immediately above said lower internal bead, with a slanted reduced thickness portion extending upward from the bottom edge of said outer skirt and merging with said circumferential reduced thickness portion and with a pull tab depending from the lower edge of said skirt adjacent said slanted reduced thickness portion, whereby by pulling said tab the portion of said skirt below said circumferential reduced thickness portion may be torn away.

2. The combination of claim 1 in which said cap also has an inner skirt slanting downwardly-inwardly below said top disk and fitting tightly inside said inside diameter of said neck, the juncture of the bottom of said top disk with said outer skirt and with said inner skirt being smoothly rounded.

3. A cap of a resilient, tearable plastic material for use on a plastic, thin-wall container of the type having a neck with a smooth inside diameter, an even top edge, and on the exterior of said neck a top bead, a first reduced diameter portion below said top bead with a substantially horizontal first shoulder above said first reduced diameter portion, a second reduced diameter portion below said first reduced diameter portion with a substantially horizontal second shoulder above said second reduced diameter portion, the external diameter of said neck between said first and second reduced diameter portions being substantially less than the external diameter of said neck above said first reduced diameter portion, said neck widening downwardly-outwardly below said second reduced diameter portion; said cap formed with a flat top disk, dimensioned to fit on top of said top edge and a peripheral outer skirt depending from said disk and adapted to fit over the outside of said neck, the exterior of said outer skirt comprising a substantially smooth cylinder, the inside of said outer skirt having an upper portion adapted to fit outside said top bead, an upper internal bead adapted to fit under said first shoulder, a lower internal bead adapted to fit under said second shoulder and into said second reduced diameter portion, the inside diameter of said outer skirt being greater above said top bead than at said top bead and greater at said top bead than at said lower bead and about the same below said lower bead as above said top bead, said outer skirt formed with a circumferential reduced thickness portion immediately above said lower internal bead, with a slanted reduced thickness portion extending upward from the bottom edge of said outer skirt and merging with said circumferential reduced thickness portion and with a pull tab depending from the lower edge of said skirt adjacent said slanted reduced thickness portion, whereby by pulling said tab the portion of said skirt below said circumferential reduced thickness portion may be torn away.

4. A cap according to claim 3 which also comprises an inner skirt slanting downwardly-inwardly below said top disk and adapted to fit tightly inside said inside diameter of said neck, the junctures of the bottom of said top disk with said outer skirt and with said inner skirt being smoothly curved.

* * * * *